US005749808A

United States Patent [19]

Harris

[11] Patent Number: 5,749,808

[45] Date of Patent: May 12, 1998

[54] STAIRWAY CLIMBING APPARATUS AND METHOD

[76] Inventor: James Alexander Harris, 6905 Tennyson Ter., Rockville, Md. 20855

[21] Appl. No.: 743,822

[22] Filed: Nov. 5, 1996

[51] Int. Cl.[6] ..... A63B 23/04; E04H 17/00

[52] U.S. Cl. ..... 482/52; 256/59

[58] Field of Search ..... 482/15, 52, 148; 473/440; 119/705; 256/1, 59, DIG. 6, DIG. 2, 60, 65; 434/247; 135/65, 66

[56] References Cited

U.S. PATENT DOCUMENTS

| | | | |
|---|---|---|---|
| 201,328 | 3/1878 | Chamberlin . | |
| 2,622,658 | 12/1952 | Morgan | 482/52 |
| 2,812,010 | 11/1957 | Abdallah | 482/51 |
| 3,564,790 | 2/1971 | Rehfeld | 256/59 |
| 4,030,255 | 6/1977 | Hartman | 256/59 |
| 4,318,454 | 3/1982 | Johnson . | |
| 4,580,777 | 4/1986 | Johnson | 482/52 |
| 4,776,581 | 10/1988 | Shepherdson . | |
| 4,856,761 | 8/1989 | Berner . | |
| 5,007,618 | 4/1991 | Libby | 256/59 |
| 5,226,439 | 7/1993 | O'Keeffe et al. | 256/59 |
| 5,499,955 | 3/1996 | Becker et al. . | |

FOREIGN PATENT DOCUMENTS

| | | |
|---|---|---|
| 536402 | 5/1922 | France . |
| 563936 | 12/1923 | France . |

*Primary Examiner*—Stephen R. Crow
*Attorney, Agent, or Firm*—Stephen R. Greiner

[57] ABSTRACT

An apparatus for assisting a user in safely climbing a stairway and a method for using the apparatus. The apparatus includes a rod and a pair of parallel rails disposed opposite one another along the flight of stairs. Each of the rails has a number of spaced notches in its upper surface so that the rails may releasably support the rod extending therebetween. In use, the rod is grasped by a user and caused to be moved from one set of notches to another thereby steadying the user as he or she walks up or down the stairs.

15 Claims, 1 Drawing Sheet

STAIRWAY CLIMBING APPARATUS AND METHOD

FIELD OF THE INVENTION

The present invention relates generally to exercise apparatus involving user translation over a stairway.

BACKGROUND OF THE INVENTION

Many elderly and disabled individuals encounter difficulties in traversing a flight of stairs. In an effort to aid such individuals, various elevator and ramp systems have been developed to permit stairways to be ascended and descended with greater ease. Unfortunately, these systems are costly to install and many building structures, including the residences of elderly and disabled individuals, are not easily adapted to accommodate them.

Since the physical fitness of an individual is not significantly improved by the use of either an elevator or a ramp system for negotiating a stairway, some therapists discourage their use during certain types of rehabilitation. Instead, the frequent use of stairways is often advocated as a means to improve muscle tone and cardiovascular fitness. A need presently exists for an apparatus that will allow an individual with impaired movement abilities to traverse a stairway without a therapist in attendance and provide for the support of the individual in the event that the individual should lose his or her balance.

SUMMARY OF THE INVENTION

In light of the problems associated with the prior art stairway systems, it is a principal object of the invention to provide an improved apparatus which permits elderly, infirm or partially disabled individuals to negotiate a flight of stairs under their own power.

It is another object of the invention to provide a method for elevating the physical fitness of an elderly and infirm individual through the use of the disclosed apparatus.

It is an object of the invention to provide improved elements and arrangements thereof in a stairway climbing apparatus for the purposes described which is uncomplicated in construction, inexpensive in manufacture, and fully dependable in use.

Briefly, the stairway climbing apparatus in accordance with this invention achieves the intended objects by featuring a pair of parallel rails disposed opposite one another along a flight of stairs. Each of the rails has a plurality of spaced notches in its upper surface. A rod is movably sustained by the notches in the rails. The rod may be grasped by a user and moved from one set of notches to another thereby steadying the user as he or she traverses the stairs.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
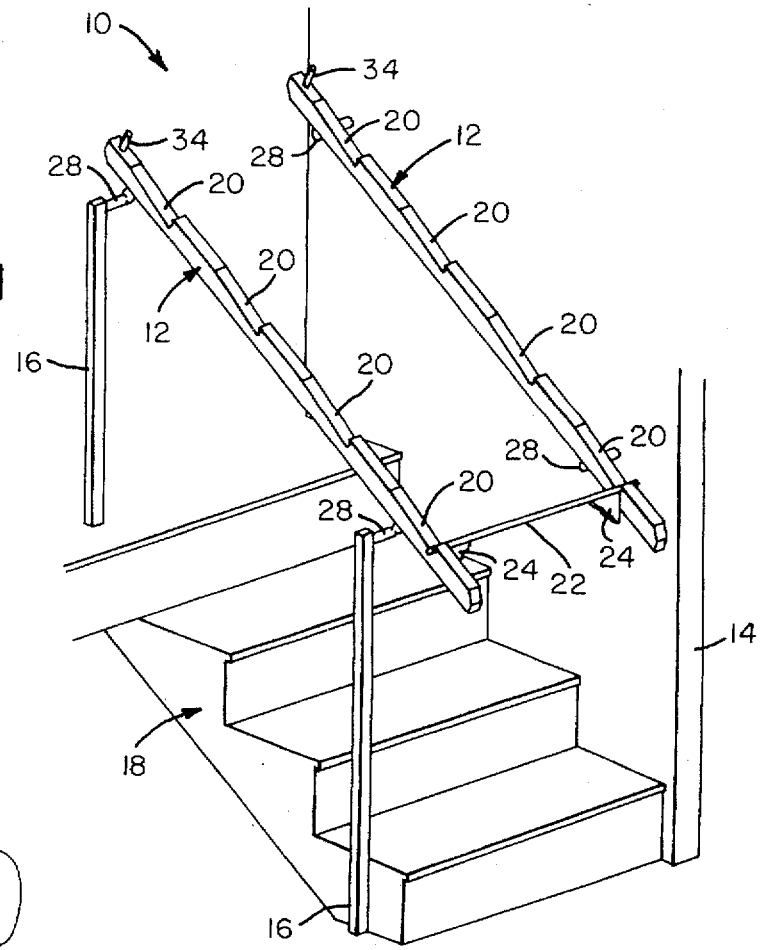
FIG. 1 is a perspective view of a stairway climbing apparatus in accordance with the present invention.
Figure 2:
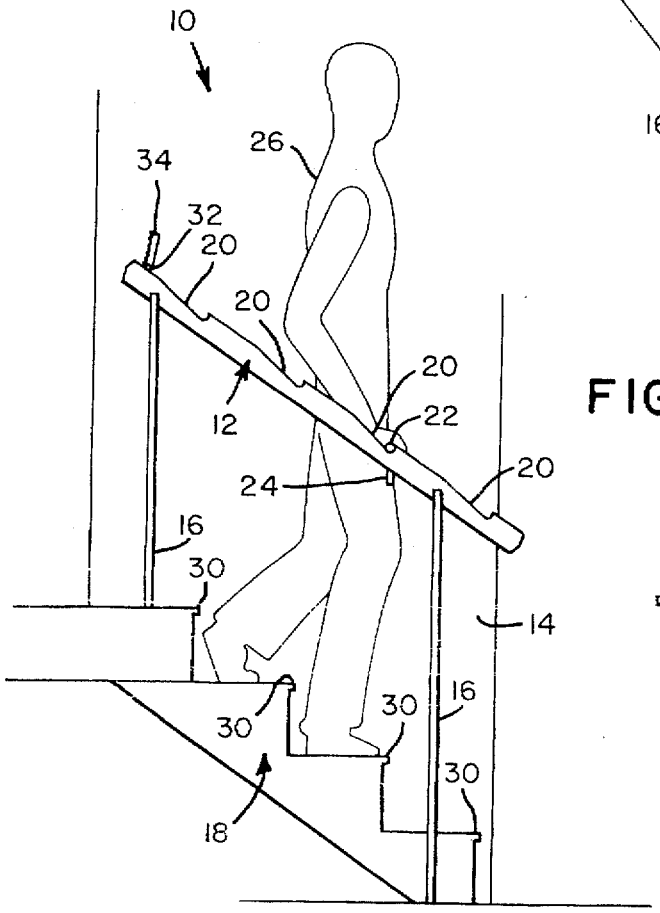
FIG. 2 is a side elevational view of the stairway climbing apparatus of FIG. 1.
Figure 3:
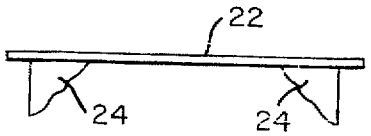
FIG. 3 is a front view of a rod for use with the apparatus.

Referring now to the FIGS., a stairway climbing apparatus in accordance with the present invention is shown at 10. The apparatus 10 includes a pair of evenly spaced rails 12 mounted respectively on a wall 14 and posts 16 positioned on opposite sides of a flight of stairs 18. The rails 12 have a series of notches 20 in their respective upper surfaces so that they may support a rod 22 extending horizontally from one rail 12 to the other. A pair of triangular guides 24 are secured adjacent the opposed ends of the rod 22 so that the rod may not be easily twisted from engagement with the rails 12. In use, the rod 22 is grasped by an elderly or infirm individual 26 and moved from one set of notches 20 to another thereby steadying the individual as he or she walks up or down the stairs 18.

A flight of stairs, such as those illustrated at 18, can be physically tiring as well as psychologically forbidding. Such should be neither too steep nor too shallow. For most situations, therefore, a rise of about seven inches (17.8 cm) and a run of about ten inches (25.4 cm) per stair is recommended. These dimensions, however, may be varied to satisfy specific user requirements.

For comfort and safety, the rise of each stair must be identical. Likewise, the distance from the top of each stair to the upper surface of each rail 12 should be constant. Preferably, this distance should be in a range of about two and one-half feet (76.2 cm) to nearly three feet (86.4 cm) to retain the rod 22 at a height where it may be conveniently grasped by the individual 26.

The rails 12 may be made in whole as shown or in sections to extend from the top of the flight of stairs 18 to the bottom thereof. It is contemplated that the stairs 18 as well as the rails 12 may be of any overall length. Preferably, the rails 12 are made of pieces of wood with rectangular cross sections but they may also be constructed from suitable metal, plastic or composite materials and with any cross-sectional configuration. Conventional metallic brackets 28 mount the rails 12 at the desired height above the stairs 18.

The location of the notches 20 in the rails 12 is dependent upon the configuration of the underlying stairs 18. Preferably, one notch 20 is provided in each rail 12 at a position directly above the nose 30 of each stair 18. Thus, regardless of which of the opposed notches 20 the rod 22 is sustained by, a user 26 of the apparatus 10 travelling either up or down the stairs 18 is provided with full and unimpeded access to a stair directly adjacent to the rod.

A relatively short handlebar 32 carrying a rubber handgrip 34 projects from the upper surface of each rail 12 proximate the top of the stairs 18. The handgrip 34 serves to steady a user travelling down the stairs while locating the rod 22 in the adjacent notches 20 and to steady the user travelling up the stairs while removing the rod from the notches.

The rod 22 is preferably made of wood having a sufficient strength to safely support the weight of a user. The triangular guides 24 are also preferably made of wood and are secured to the rod 22 by adhesive cement so that they closely yet slidably fit between the opposed rails 12. Each of the guides 24 projects downwardly from the rod 22 about eight inches (20 cm) in a common plane. These downward projections permit the rod 22 to be lifted a short distance from a pair of opposed notches 20 and moved to an adjacent pair of notches but prevent the rod from laterally sliding or twisting from engagement with either of the rails 12. If desired, a basket (not shown) may be secured to the rod 22 between the guides 24 for carrying a small load.

In use, the rod 22 is first suspended from the rails 12 by manually positioning each of its opposed ends within one of the notches 20 in each of the rails. Next, each of the opposed ends of the rod 22 is caused to move to another one of the notches 20 in each of the rails. In moving the rod 22, its opposed ends are preferably slid along the respective upper surfaces of the rails 12 from one notch 20 to another by a user, such as the one shown at 26, walking closely behind the rod. In the alternative, the opposed ends of the rod 22 may be elevated above the respective upper surfaces of the rails 12, transported to a pair of selected notches 20, and finally lowered into the desired notches.

While the invention has been described with a high degree of particularity, it will be appreciated by those skilled in the art that numerous modifications and substitutions may be made thereto. For example, the apparatus may be constructed as a freestanding device for the sole purpose of conducting physical therapy exercises or the apparatus may be assembled in stairwells of existing buildings to assist individuals in travelling between floors. Therefore, it is to be understood that the present invention is not limited to the sole embodiment described above, but encompasses any and all embodiments within the scope of the following claims.

I claim:

1. A stair climbing apparatus, comprising:

a pair of rails for mounting on opposite sides of a flight of stairs, said rails having plurality of spaced notches in their respective upper surfaces;

a rod adapted to be sustained by said notches in said rails; and, a pair of guides secured adjacent the opposed ends of said rod for allowing said rod to be lifted from said rails but preventing said rod from laterally sliding or twisting from engagement with said rails.

2. The stairway climbing apparatus according to claim 1 further comprising a plurality of brackets secured to each of said rails for mounting such on supporting surfaces on opposite sides of a flight of stairs.

3. The stairway climbing apparatus according to claim 1 further comprising a handgrip extending from the upper surface of each of said rails adjacent one end thereof.

4. The stairway climbing apparatus according to claim 1 wherein each of said guides has a planar surface positioned in a plane substantially orthagonal to the longitudinal axis of said rod for engaging the side of one of said rails.

5. The stairway climbing apparatus according to claim 1 wherein said pair of rails, said rod and said pair of guides are constructed of wood.

6. A stairway climbing apparatus, comprising:

a flight of stairs;

a pair of parallel rails disposed opposite one another along said flight of stairs, each of said rails having a plurality of spaced notches in its upper surface; and, a rod movably sustained by said notches in said rails.

7. The stairway climbing apparatus according to claim 6 further comprising a pair of guides secured adjacent the ends of said rod for retaining said rod on said rails.

8. The stairway climbing apparatus according to claim 7 wherein each of said guides has a planar surface positioned in a plane substantially orthagonal to the longitudinal axis of said rod for engaging the side of one of said rails.

9. The stairway climbing apparatus according to claim 6 further comprising a plurality of brackets secured to each of said rails for mounting said rails on supporting surfaces located on opposite sides of a said flight of stairs.

10. The stairway climbing apparatus according to claim 6 further comprising a handgrip extending from each of said rails at the end thereof positioned adjacent the top of said flight of stairs.

11. The stairway climbing apparatus according to claim 6 wherein said pair of rails, said rod and said pair of guides are constructed of wood.

12. A method of climbing a stairway including the steps of:

providing a pair of inclined rails along the opposite sides of a flight of stairs wherein each of said inclined rails has a plurality of spaced notches in its upper surface;

providing a rod for suspension between said inclined rails;

suspending said rod from said inclined rails by positioning each of the opposed ends of said rod within one of said notches in each of said inclined rails; and, causing each of the opposed ends of said rod to move to another one of said notches in each of said inclined rails.

13. The method of claim 12 further including the step of partially supporting the weight of the body of a user on said rod when each of the opposed ends of said rod is positioned said notches of said inclined rails.

14. The method of claim 12 wherein the step of causing each of the opposed ends of said rod to move to another one of said notches in each of said inclined rails is carried out by sliding the opposed ends of said rod along the respective upper surfaces of said inclined rails.

15. The method of claim 12 wherein the step of causing each of the opposed ends of said rod to move to another one of said notches in each of said inclined rails is carried out by first elevating said rod above the respective upper surfaces of said inclined rails, then transporting said rod over the respective upper surfaces of said inclined rails, and finally lowering said rod onto said inclined rails.

* * * * *